US010352175B2

(12) United States Patent
Dawson et al.

(10) Patent No.: US 10,352,175 B2
(45) Date of Patent: Jul. 16, 2019

(54) SEAL-PLATE ANTI-ROTATION IN A STAGE OF A GAS TURBINE ENGINE

(71) Applicant: ROLLS-ROYCE plc, London (GB)

(72) Inventors: John Dawson, Derby (GB); Peter C Burford, Derby (GB)

(73) Assignee: ROLLS-ROYCE plc, London (GB)

( * ) Notice: Subject to any disclaimer, the term of this patent is extended or adjusted under 35 U.S.C. 154(b) by 430 days.

(21) Appl. No.: 15/258,721

(22) Filed: Sep. 7, 2016

(65) Prior Publication Data

US 2017/0191370 A1 Jul. 6, 2017

(30) Foreign Application Priority Data

Sep. 21, 2015 (GB) ..... 1516657.2

(51) Int. Cl.

| | |
|---|---|
| ***F01D 5/18*** | (2006.01) |
| ***F01D 11/00*** | (2006.01) |
| ***F01D 5/08*** | (2006.01) |
| ***F01D 5/30*** | (2006.01) |

(52) U.S. Cl.

CPC ..... *F01D 5/187* (2013.01); *F01D 5/081* (2013.01); *F01D 5/082* (2013.01); *F01D 5/3007* (2013.01); *F01D 5/3015* (2013.01); *F01D 11/003* (2013.01); *F05D 2220/32* (2013.01); *F05D 2230/21* (2013.01); *F05D 2230/239* (2013.01);

(Continued)

(58) Field of Classification Search

None

See application file for complete search history.

(56) References Cited

U.S. PATENT DOCUMENTS 3,395,891 A * 8/1968 Burge ..... F01D 5/323 416/196 R 3,853,425 A 12/1974 Scalzo et al.

(Continued)

FOREIGN PATENT DOCUMENTS

DE 102006054154 A1 5/2008

EP 1772592 A2 4/2007

(Continued)

OTHER PUBLICATIONS

Jan. 30, 2017 Extended Search Report issued in European Patent Application No. 16187635.4.

(Continued)

*Primary Examiner* — Justin D Seabe

*Assistant Examiner* — Jason A Fountain

(74) *Attorney, Agent, or Firm* — Oliff PLC

(57) ABSTRACT

A turbine stage assembly includes a disc carrying a cascade of blades and an annular seal-plate that is secured to the disc by a first connection. One or more of the blades include a root portion configured to be received in a complementarily shaped radially extending slot in the disc such that a face of the root portion faces the plate. A terminal portion of the root portion is cut away adjacent the face to present an open space between a radially inner wall of the slot and a wall of the cutaway root portion. A first part of a second connector extends radially inwardly from the wall of the cutaway root portion. The first part of the second connector is configured to engage with a complementing second part of the second connector provided on the seal-plate.

14 Claims, 3 Drawing Sheets

(52) U.S. Cl.
CPC ..... *F05D 2230/31* (2013.01); *F05D 2260/20* (2013.01)

(56) References Cited

U.S. PATENT DOCUMENTS

| | | | | |
|---|---|---|---|---|
| 4,047,837 | A * | 9/1977 | Hueber | F01D 5/081 138/42 |
| 4,279,572 | A * | 7/1981 | Auriemma | F01D 5/323 416/220 R |
| 5,941,687 | A | 8/1999 | Tubbs | |
| 9,188,011 | B2 | 11/2015 | Khanin | |
| 10,151,205 | B2 | 12/2018 | Barry et al. | |
| 2004/0115054 | A1 | 6/2004 | Balland et al. | |
| 2006/0275125 | A1 | 12/2006 | Bibor et al. | |
| 2012/0134845 | A1 | 5/2012 | Khanin | |
| 2016/0312621 | A1 | 10/2016 | Barry et al. | |

FOREIGN PATENT DOCUMENTS

| | | | |
|---|---|---|---|
| EP | 2 400 116 | A2 | 12/2011 |
| EP | 3 002 410 | A1 | 4/2016 |
| EP | 3 088 669 | A1 | 11/2016 |
| GB | 2 194 000 | A | 2/1988 |
| GB | 2452515 | A | 3/2009 |

OTHER PUBLICATIONS

Jan. 24, 2017 Search Report issued in European Patent Application No. 16 18 7636.
Feb. 1, 2016 Search Report issued in British Application No. GB1516657.2.
U.S. Appl. No. 15/258,701, filed Sep. 7, 2016 in the name of Peter Burford.
Mar. 7, 2016 Great Britain Search Report issued in Great Britain Patent Application No. GB1519026.7.
Jan. 8, 2019 Office Action issued in U.S. Appl. No. 15/258,701.

* cited by examiner

SEAL-PLATE ANTI-ROTATION IN A STAGE OF A GAS TURBINE ENGINE

TECHNICAL FIELD

The present disclosure concerns the prevention of rotation of a seal-plate arranged with respect to a turbine rotor (a disc carrying a circumferential cascade of blades) of a gas turbine engine to contain coolant for delivery to the blade body. More particularly, the invention is directed to a novel blade configuration and corresponding seal-plate configuration which serves to prevent relative rotation of the seal-plate with respect to a turbine rotor of which the blade is a component.

BACKGROUND TO THE INVENTION

In a gas turbine engine, ambient air is drawn into a compressor section. Alternate rows of stationary and rotating aerofoil blades are arranged around a common axis, together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

It is well known that the operating efficiency of a gas turbine engine is improved by increasing the operating temperature. The ability to optimise efficiency through increased temperatures is restricted by changes in behaviour of materials used in the engine components at elevated temperatures which, amongst other things, can impact upon the mechanical strength of the blades and rotor disc which carries the blades. This problem is addressed by providing a flow of coolant through and/or over the turbine rotor disc and blades.

It is known to take off a portion of the air output from the compressor (which is not subjected to ignition in the combustor and so is relatively cooler) and feed this to surfaces in the turbine section which are likely to suffer damage from excessive heat. Typically the cooling air is delivered adjacent the rim of the turbine disc and directed to a port which enters the turbine blade body and is distributed through the blade, typically by means of a labyrinth of channels extending through the blade body.

Cooling air from the compressor arrives at the face of the turbine rotor disc and is contained by means of an annular seal-plate aligned co-axially with the turbine rotor a short axial distance from the rotor to provide an annular reservoir of coolant. Small ducts extend from this reservoir to the roots of the blades which contain a labyrinth of cooling channels within their bodies. The air is drawn into the blades and circulates through the labyrinth to cool the blade body.

A seal plate is conventionally secured to both the blades and disc of the rotor. In known arrangements, this is achieved by spigot connections between the plate and the disc at a radially inward portion of the plate and disc and separate, anti-rotation connection adjacent the rim of the plate with each of the blade roots. On an end facing downstream of the coolant flow, the blade roots each have a solid face into which is provided a recess of substantially rectangular cross section. The plate is provided with an array of protrusions, also of substantially rectangular cross section, each sized to fit snugly into a blade root recess. It will be appreciated that manufacturing tolerances for the recesses and protrusions are necessarily tight to ensure a sealing engagement between each plate protrusion and a corresponding blade recess.

The invention provides an alternative plate to blade root connector arrangement which serves the anti-rotation function and provides identifiable benefits to the manufacturer.

STATEMENT OF THE INVENTION

In accordance with a first aspect, the present invention provides a turbine stage assembly, the assembly comprising; a disc carrying a cascade of blades and an annular seal-plate, the seal-plate being secured to the disc by a first connection means, one or more of the blades comprising; a root portion configured to be received in a complementarily shaped radially extending slot in the disc such that a face of the root portion faces the seal-plate; a terminal portion of the root portion being cut away adjacent the face to present an open space between a radially inner wall of the slot and a wall of the cutaway root portion and a first part of a second connector means extending radially inwardly from the wall of the cutaway root portion, the first part of the second connector means configured to engage with a complementing second part of the second connector means provided on the seal-plate.

In the context of the present invention the term "radially" is to be understood to refer to radii extending from a rotational centre of a disc which carries the blade and seal-plate.

In another aspect, the invention provides a turbine blade configured for use in a disc of the first aspect, the blade comprising; a root portion, a terminal portion of the root portion being cut away adjacent a first face to present an open space extending from the first face towards a first wall of the cutaway root portion arranged in parallel to the first face, a first part of a connector means extending radially inwardly from a second wall (extending orthogonally to the first face) of the cutaway root portion, the first part of the connector means configured, in use, to engage with a complementing second part of the connector means provided on a seal-plate.

It will be appreciated that blades in accordance with the invention could be retro-fitted to disc and seal-plate assemblies known from the prior art to produce a turbine stage assembly in accordance with the invention.

The first part of the second connector portion (provided on the blade) may conveniently comprise a pair of tangs defining a slot into which a protrusion forming the second part of the second connector can be received. In a simple embodiment the tangs may follow the line of the recess into which the blade is received in the disc and define a straight sided slot therein. The proportions of the first and second parts are configured to resist rotational movement of the seal-plate relative to a blisk comprising the blade. Alternatively, the first part may comprise a single shaped piece defining an open sided recess into which the second part can be received. The open sided recess may, for example, have an arched or C shape. In other embodiments, the recess may be defined by three walls of a rectangle. In another alternative the recess may be defined by three walls of a trapezoid.

The first part may be integrally cast with a blade. Optionally, the first part is added to an already cast blade, for example, the first part is built onto the blade using an additive layer manufacturing method. Alternatively, the first part is manufactured as a separate component and welded or otherwise secured to an already manufactured blade. The skilled person will understand that whilst casting is a commonly used and desirable method of manufacture for turbine blades, other methods of manufacture are possible and can be used to manufacture blades as described in accordance with the invention.

The portion that is cut away from the root portion is optionally substantially cuboid resulting in a face on the wall of the cutaway root portion facing and in parallel alignment with the axis of the radial slot. Such an arrangement is, however, not essential. For example, the shape of the portion cut away from the root portion may be configured to result in an inclined and/or curved face on the wall of the cutaway root portion. The wall of the cutaway portion may include an orifice which opens into a cooling passage inside the body of the blade for delivery of coolant to the cooling passage. Adjacent the cutaway portion, the root portion may define a wall of a duct, the wall providing, in use, a heat shield for the base of the radially extending slot into which the root portion is received. The duct may be arranged to receive cooling air and further may be in fluid communication with cooling channels extending through the root portion and into the blade main body. An inlet to a cooling channel may be arranged adjacent the cutaway portion.

It will be understood that providing the "cutaway" of the blades of the present invention need not involve a cutting operation on a conventionally designed blade. For example, novel blades may be cast to include the cutaway in the root portion. The skilled person will understand that whilst casting is a commonly used and desirable method of manufacture for turbine blades, other methods of manufacture are possible and can be used to manufacture blades as described in accordance with the invention.

The root portion may have a "fir-tree" shape in cross-section configured to be received in a complementing fir-tree shaped radially extending slot in a disc, the cutaway portion may be arranged only in the tip section of the fir-tree. The skilled person will understand that other configurations for the blade root portion and recess of the disc are possible and it would be well within their capabilities to adopt the present invention in those alternative configurations without the need for further inventive thought.

BRIEF DESCRIPTION OF THE FIGURES

Embodiments of the invention will now be further described by way of example with reference to the accompanying Figures in which;

FIG. 2(*b*) shows an alternative view of a blade of the blisk of FIG. 2(*a*);

FIG. 2(*c*) shows the blade of FIGS. 2(*a*) and 2(*b*) engaging with a seal-plate, the seal-plate bearing a second part of an anti-rotation connector in accordance with an embodiment of the invention;

DETAILED DESCRIPTION OF FIGURES AND EMBODIMENTS

Figures 1, 1A, 1B:
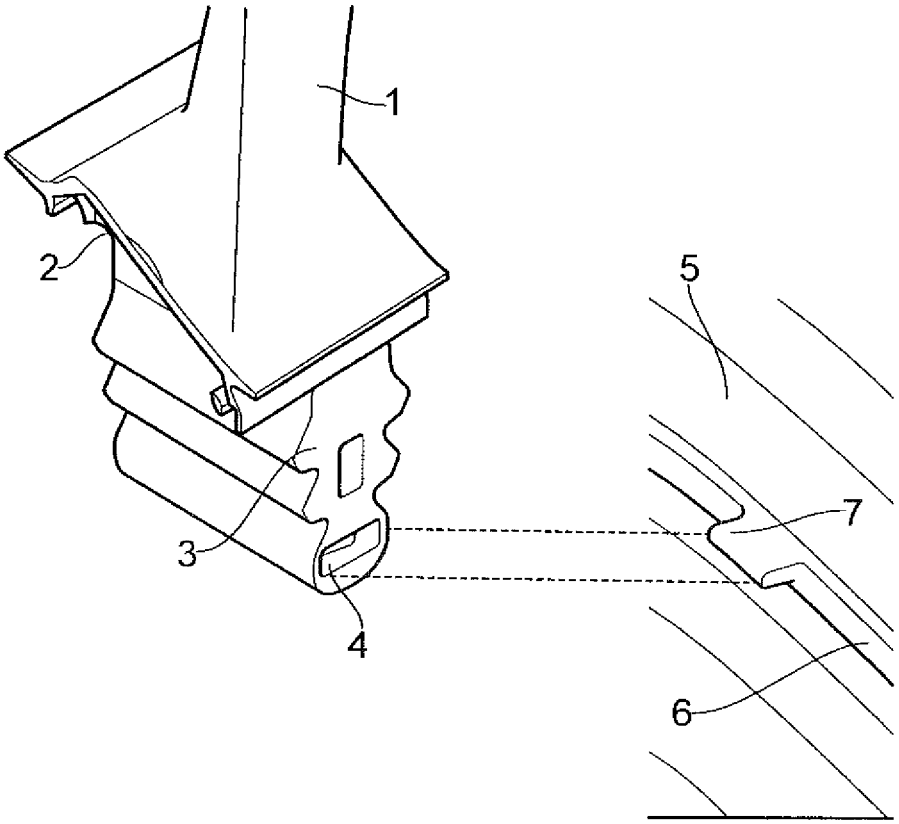
FIG. 1 (Prior Art)
FIG. 1 shows a blade (FIG. 1(*a*)) and a seal-plate (FIG. 1(*b*)) bearing first and second parts of an anti-rotation connector as is known in the prior art.

As can be seen in FIG. 1, a known blade configuration comprises a main blade body 1 extending in a first direction from a platform 2 and a root portion 3 extending in a direction opposite to the first direction. The root portion 3 comprises a substantially solid piece having a fir-tree shaped profile. In the tip of the fir tree there is provided a substantially rectangular recess 4 which forms the first part of an anti-rotation connector 4, 7 which, in use, connects a seal-plate 5 to the blade root portion 3. FIG. 1(*b*) shows a seal-plate 5 bearing the second part 7 of the connector 4, 7. As can be seen, the second part 7 comprises a substantially cuboid protrusion extending from a circumferential rim 6 of the seal-plate 5. Dotted lines in the Figure indicate how the second part 7 is received in the first part 4. In such known arrangements, the rim 6 is provided with a plurality of protrusions 7 for engaging with an equal plurality of recesses 4 in blade root portions 3 received in fir-tree shaped radially extending slots in a disc (not shown).

Figure 2A:
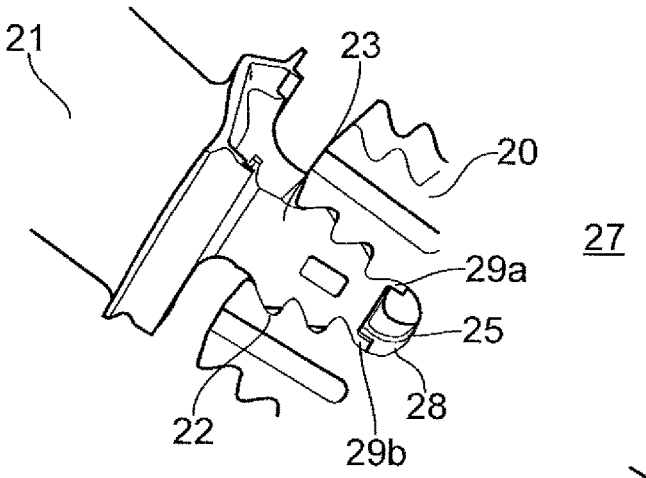
FIG. 2(*a*) shows a blisk having a blade bearing a first part of an anti-rotation connector in accordance with an embodiment of the invention.
Figure 2B:
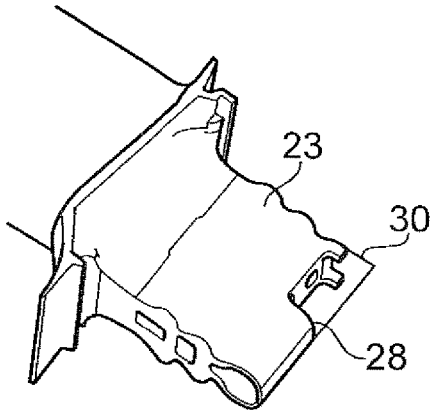
Figure 2C:
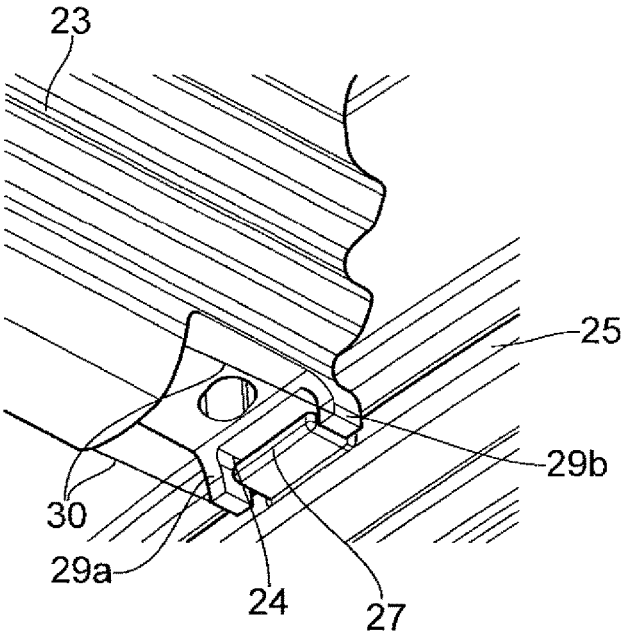

FIG. 2 shows a connector arrangement in accordance with an embodiment of the invention. In FIG. 2(*a*) a blade having a body 21 and a root portion 23 is received in a complementing fir-tree shaped radially extending recess 22 of a disc 20. In the region at the tip of the fir-tree shaped root portion 23, a section has been removed to provide a cutaway portion 28. The portion is bounded by a wall 26 of a duct also provided in the tip of the fir-tree shaped root portion 23, the duct having an inlet on an opposite face of the root portion. The wall 26 serves to provide a heat shield for the tip of the fir-tree shaped recess or "bucket groove" as it is sometimes described. Extending from the cutaway root portion 23 towards the bucket groove is a pair of tangs 29*a*, 29*b* defining a space 24 therebetween (see FIG. 2(*c*)) for receiving a protrusion 27.

In FIGS. 2(*b*) and 2(*c*) the dotted lines 30 represent the region cut away from the root portion 21 when compared to the root portion 3 of the prior art arrangement of FIG. 1. In FIG. 2(*c*), the seal-plate 25 has substantially the same configuration as the seal-plate 5 of FIG. 1(*b*).

Figure 3:
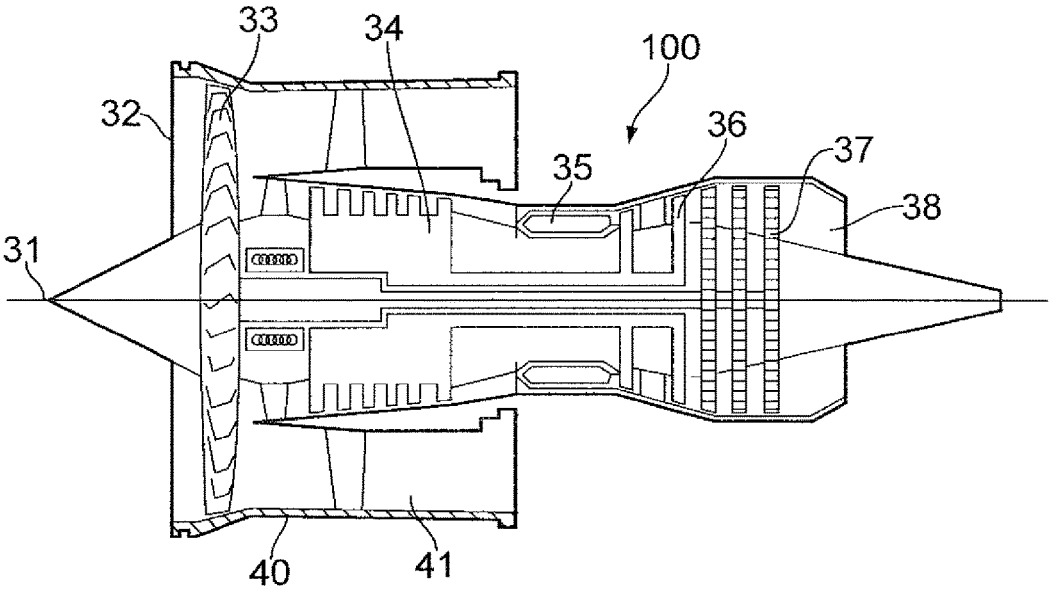
FIG. 3 shows a gas turbine engine into which turbine stage assemblies in accordance with the invention may be incorporated.

With reference to FIG. 3, a gas turbine engine is generally indicated at 100, having a principal and rotational axis 31. The engine 100 comprises, in axial flow series, an air intake 32, a propulsive fan 33, a high-pressure compressor 34, combustion equipment 35, a high-pressure turbine 36, a low-pressure turbine 37 and an exhaust nozzle 38. A nacelle 40 generally surrounds the engine 100 and defines the intake 32.

The gas turbine engine 100 works in the conventional manner so that air entering the intake 32 is accelerated by the fan 33 to produce two air flows: a first air flow into the high-pressure compressor 34 and a second air flow which passes through a bypass duct 41 to provide propulsive thrust. The high-pressure compressor 34 compresses the air flow directed into it before delivering that air to the combustion equipment 35.

In the combustion equipment 35 the air flow is mixed with fuel and the mixture combusted. The resultant hot combustion products then expand through, and thereby drive the high and low-pressure turbines 36, 37 before being exhausted through the nozzle 38 to provide additional propulsive thrust. The high 36 and low 37 pressure turbines drive respectively the high pressure compressor 34 and the fan 33, each by a suitable interconnecting shaft.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

In arrangements of the present invention it is envisaged that not all blades need include the first part of the second connector. For example, the first part may be provided on every second or every third blade. Equally, the seal-plate need not require a second part of the second connector for each blade.

Expected benefits of the present invention include; a reduction in weight potentially leading to an improvement in efficiency; improved access for inspection of a cooling inlet duct and associated cooling passages extending through the blade root portion; and, a relaxation in tolerances for the manufacture of second part protrusions on the seal-plate resulting in more efficient manufacture of that component. Reduction of the numbers of anti-rotation connectors between the blades and seal-plate can further simplify manufacture, reduce weight and reduce manufacturing costs.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A turbine stage assembly comprising:

a disc carrying a cascade of blades and an annular seal-plate, the annular seal-plate being secured to the disc by a first connection means;

one or more of the blades comprising a main body and a root portion configured to be received in a complementarily shaped radially extending recess in the disc such that a face of the root portion faces the annular seal-plate, the root portion defining a wall of a duct, the wall of the duct providing, in use, a heat shield for the base of the radially extending recess into which the root portion is received, the duct being arranged to receive cooling air and being in fluid communication with cooling passages extending through the root portion and into the main body of the blade;

a terminal portion of the root portion being cut away axially adjacent the wall of the duct to the face of the root portion to present an open space between a radially inner wall of the radially extending recess and a radially opposing wall of the cutaway root portion that includes an orifice that opens into a cooling passage inside the main body of the blade for delivery of coolant to the cooling passage; and a first part of a second connector means extending radially inwardly from the radially opposing wall of the cutaway root portion towards the radially inner wall of the radially extending recess and partly across the open space, the first part of the second connector means comprising a pair of tangs defining a slot into which is received a protrusion forming a complementing second part of the second connector means extending from the seal-plate.

2. The turbine stage assembly as claimed in claim 1 wherein the tangs of the first part of the second connector means are configured to follow walls of the radially extending recess and define a straight sided slot between the tangs.

3. The turbine stage assembly as claimed in claim 2 wherein the cutaway root portion is configured to result in an inclined and/or curved face on the radially opposing wall of the cutaway root portion.

4. The gas turbine engine comprising one or more turbine stage assemblies, the turbine stage assemblies having a configuration according to claim 3.

5. The turbine stage assembly as claimed in claim 2 wherein the first part of the second connector means is integrally cast into the blade.

6. The gas turbine engine comprising one or more turbine stage assemblies, the turbine stage assemblies having a configuration according to claim 5.

7. The gas turbine engine comprising one or more turbine stage assemblies, the turbine stage assemblies having a configuration according to claim 2.

8. The turbine stage assembly as claimed in claim 1 wherein the cutaway root portion is configured to result in an inclined and/or curved face on the radially opposing wall of the cutaway root portion.

9. The turbine stage assembly as claimed in claim 8 wherein the first part of the second connector means is integrally cast into the blade.

10. The gas turbine engine comprising one or more turbine stage assemblies, the turbine stage assemblies having a configuration according to claim 9.

11. The gas turbine engine comprising one or more turbine stage assemblies, the turbine stage assemblies having a configuration according to claim 8.

12. The turbine stage assembly as claimed in claim 1 wherein the first part of the second connector means is integrally cast into the blade.

13. The gas turbine engine comprising one or more turbine stage assemblies, the turbine stage assemblies having a configuration according to claim 12.

14. The turbine engine comprising one or more turbine stage assemblies, the turbine stage assemblies having a configuration according to claim 1.

* * * * *